United States Patent [19]

Vaginay

[11] 4,025,300

[45] May 24, 1977

[54] PROCESS OF DYEING ARTICLES MADE FROM POLYESTERAMINES

[75] Inventor: Yves Vaginay, Lyon, France

[73] Assignee: Rhone-Poulenc-Textile, France

[22] Filed: Jan. 17, 1975

[21] Appl. No.: 541,774

[30] Foreign Application Priority Data

Jan. 17, 1974 France ..... 74.01851

[52] U.S. Cl. ..... 8/4; 8/17; 8/115.5; 8/168 AC; 260/75 N

[51] Int. Cl.[2] ..... D06P 5/00; C08G 63/20

[58] Field of Search ..... 8/4, 17, 115.5, 168; 260/75 N

[56] References Cited

UNITED STATES PATENTS

| | | | |
|---|---|---|---|
| 2,739,958 | 3/1956 | Lincoln et al. | 260/75 |
| 3,188,228 | 6/1965 | Magat et al. | 117/62 |
| 3,340,211 | 9/1967 | Eschenmoser et al. | 260/9 |
| 3,424,820 | 1/1969 | Magat et al. | 260/857 |
| 3,432,250 | 3/1969 | Miller et al. | 8/29 |
| 3,432,467 | 3/1969 | Davies et al. | 260/47 |
| 3,597,150 | 8/1971 | Brown et al. | 8/168 |
| 3,700,399 | 10/1972 | Shimauchi et al. | 8/30 |
| 3,730,681 | 5/1973 | Trapasso et al. | 8/168 |
| 3,744,968 | 7/1973 | Fuest | 8/21 D |
| 3,823,117 | 7/1974 | Freudenberger | 260/75 N |
| 3,834,867 | 9/1974 | Matter et al. | 8/115.5 |
| 3,835,099 | 9/1974 | Munakata et al. | 260/75 N |
| 3,867,479 | 2/1975 | Spanninger | 260/860 |
| 3,886,230 | 5/1975 | Marcus | 260/860 |
| 3,980,620 | 9/1976 | Vaginay | 260/75 N |

FOREIGN PATENTS OR APPLICATIONS

| | | |
|---|---|---|
| 7,206,928 | 11/1972 | Netherlands |

*Primary Examiner*—Joseph L. Schofer
*Assistant Examiner*—A. L. Clingman
*Attorney, Agent, or Firm*—Stevens, Davis, Miller & Mosher

[57] ABSTRACT

Articles made from polyesteramines such as filaments, fibers and molded products are dyed by treating the article with an alkylating agent in the form of a solution or emulsion in an amount of at least 1.5% by weight based on the weight of the article and at a temperature higher than room temperature for at least 15 minutes. The article is then dyed with a conventional anionic dye and preferably these two steps are carried out simultaneously.

9 Claims, No Drawings

PROCESS OF DYEING ARTICLES MADE FROM POLYESTERAMINES

This invention relates to a process for dyeing articles made from polyesteramines with anionic dyestuffs and to the filament yarns, staple fibers and molded articles obtained from this process.

It is known to be difficult to dye shaped articles made from polyesters derived from aromatic diacids, particularly from terephthalic acid and aliphatic, alicyclic or cycloaliphatic diols containing at least three carbon atoms in the molecule owing to the absence of reactive sites in the macromolecular chains. Since these polyesters are of great interest for a variety of end uses, it has been proposed to remedy this major drawback in French patent applications 71/18 744 and 71/46 680 by introducing quaternary ammonium groups in the chains of these polymers during their preparation. But such polymers modified during the interchange or the polycondensation exhibit either a too low viscosity and a more or less strong coloration, or even a bad dyeing affinity due to a decomposition of quaternary ammonium salts into volatile products.

It is also known, from U.S. Pat. No. 3,424,820, to improve the dyeing affinity of polyamides or polyesters by grafting on the polymer, yarn or fabric a primary or tertiary amine which may be either already or further quaternized. This laboratory radiation grafting process, however, is expensive, technically complicated, and cannot be used commercially.

Finally, in French patent application 71/36 513 fibers made from polyester have been dyed with an anionic dyestuff in the presence of a non-functional quaternary ammonium compound. The yield is poor and consequently this process is not very profitable.

The present invention provides a process for dyeing molded articles made from polyesteramines, in which the article is treated with a solution or emulsion containing at least 1.5% by weight, of an alkylating agent, based on the weight of the article treated, at a temperature higher than room temperature for at least 15 minutes, and dyeing the article obtained with an anionic dyestuff in the usual, conventional manner.

Preferably, the treatment with the alkylating agent and the dyeing step are carried out simultaneously.

This invention also relates to shaped articles obtained according to this process.

The term polyesteramines encompasses copolymers obtained by polycondensating at least an aromatic diacid which may contain up to 12 carbon atoms or even more and at least an aliphatic, alicyclic or cycloaliphatic diol containing at least three carbon atoms, in the presence of at least a compound having a tertiary amino group, such as described in French patent application 73/36 977, filed on Oct. 15, 1973 and entitled "Polyesteramines with Improved Dye Affinity".

The polyesteramine issues from:

a. at least an aromatic dicarboxylic diacid and possibly a small amount of an aliphatic diacid;

b. at least a diol selected from the group consisting of an aliphatic diol, saturated alicyclic diol and a cycloaliphatic diol, said diol having at least three carbon atoms in the molecule;

c. at least a compound of the formula $NR_3$ where R, being the same or different, is alkyl, saturated alicyclic, cycloalkyl or arylaliphatic, or where two R groups form a cycle between them.

The $NR_3$ compound has 1, 2 or 3 R groups containing 0, 1, 2 or 3 ester generating groups with the total number of ester generating groups being 1 to 3. The $NR_3$ compound has no more than two R groups being arylaliphatic or cycloaliphatic which have only one carbon atom between the cycle and the nitrogen atom or being saturated alicyclic and there are at least 3 or more carbon atoms between each of the ester generating groups and the nitrogen atom.

The total amount of said $NR_3$ compound is present so that the percentage of nitrogen fixed on the polymer is from 0.03% to 1.0% by weight of the polymer.

This invention usually relates to polyesteramines molten spun in a known manner at a temperature, for example, of between 150° and 320° C. The fibers are drawn according to any process known by those skilled in the art, such as spin-drawing or any other method at a temperature between room temperature and about 320° C, and then the fibers can be optionally subjected to any other known fiber treatment such as, for example, crimping, or texturizing. The products treated according to the invention may be yarns, fibers, woven or knitted fabrics, etc.

The polyesteramines may also be molded according to any process known by those skilled in the art. The shaped articles obtained are treated by a rather strong alkylating agent, which can be either dissolved in a solvent, in a solvent mixture or in the form of an emulsion when the alkylating agent is not soluble. The treating temperature can be higher than room temperature, for example, at a temperature near the boiling temperature of the reaction medium used and the treatment time is for at least 15 minutes, usually betwen 15 minutes and 1 hour, with the treatment being done possibly in the presence of a carrier. As a carrier, 1,2,4-trichlorobenzene is preferably used.

The amount of alkylating agent needed for the treatment is at least 1.5% by weight based on the weight of the treated article and preferably at least 5%. Normally it is unnecessary to exceed 10% by weight based on the weight of the article.

There exists, of course, an interrelation between the several treatment factors, such as temperature, duration, percentage and nature of the alkylating agent. Thus, the stronger the alkylating agent, the more rapid will be the treatment for a given concentration of alkylating agent and a given temperature.

Suitable alkylating agents include esters of strong acids, such as trichloroacetates, iodides, bromides, chlorides, such as allyl or benzyl chlorides, methyl iodide, sulfates, phosphates, phosphonates, and sulfonates such as methyl paratoluene sulfonate.

The alkylating agent may be either dissolved in a solvent, or in an emulsion form, the reaction medium being preferably a polar compound. Suitable compounds include alcohols, such methanol, isopropanol, isobutanol, toluene, and water which is the most economic and easy to use compound.

The alkylating agent is preferably incorporated into the dyeing bath in order to avoid an additional handling step and to make the process more economical.

When dyeing and alkylating treatments are conducted in separate steps, dyeing is carried out by means of an anionic dye at a temperature between room temperature and 200° C or even higher if the article can withstand the temperature. The dyeing time can range from a few seconds to about one hour and the process can optionally be conducted in the presence of a carrier such as 1,2,4-trichlorobenzene.

The dyeing of polyesteramines with aionic dyes in this manner can be carried out very easily and with great efficiency. The process has been found to be much more efficient than dyeing polyesteramines according to the method of the French application 73/36 977, in which the dyeing treatment is performed without an alkylating agent.

It has been surprisingly found that only polyesteramines made from diols having at least three carbon atoms in the molecule as taught in French Patent Application 73/36 977 are suitable for the embodiment of the present process. Other polyesteramines, such as those made from ethylene glycol, exhibit an original coloration which modifies the final coloration, particularly in the lighter shades. Similarly when dyeing by printing, since the whole surface of the article is not necessarily dyed, any original fiber coloration renders the fiber unacceptable.

Shaped articles dyed according to the present method, such as filament yarns, staple fibers or molded articles, have excellent color fastness to washing, dry-cleaning and sublimation.

Since the fabrics made from polyester-wool blends can be dyed in one bath, the present process yields a great economic advantage.

It is also possible to obtain various effects such as very successful Camaieu effects by dyeing filaments made from polyesteramines of which only some have been processed with an alkylating agent. Contrasting shades may be obtained by dyeing blends of yarns with some being dyeable with cationic dyes and others dyeable with anionic dyes according to the present process.

The following examples, in which the parts and percentages are expressed on a weight basis, are given for information to further illustrate the invention and they are not to be interpreted as restricting the present invention which is defined in the claims.

In these examples dyestuffs are mentioned by their CI reference (Color Index edition and its additions) and the viscosity index, VI, is determined from the viscosity in solution measured at 25° C on a 1% by weight per volume solution of polymer in orthochlorophenol by the formula:

$$VI = \frac{\text{specific viscosity} \times 1000}{\text{concentration}}$$

in which concentration is expressed in g100 cm$^3$.

EXAMPLE 1

A. A polymer is prepared in the usual manner from polybutyleneterephthalate containing 0.8% by mole of N,N-di(ω-hydroxyhexyl)hexylamine with the following characteristics:

| | |
|---|---|
| VI | 1040 |
| Softening point | 224.2° C |

After drying, the polymer is spun through a spinneret pierced with 23 holes of 0.34 mm diameter and the filaments are pin-drawn at 80° C and plate-drawn at 120° C at a draw ratio of 4.7 ×.

The yarn obtained has the following characteristics:

| | |
|---|---|
| Total count | 73 dtex |
| Dry tenacity | 38 g/tex |
| Elongation | 14.8% |

A dye bath containing 0.4 g of CI Acid Red 266, 1 g of diammonium phosphate, 0.5 g of a condensate of stearyl and oleylamines with ethylene oxide and enough water to make 1 liter is prepared. Dyeing is carried out at the boil with a bath to yarn ratio (ml/g) of 100 in the presence of 20% 1,2,4-trichlorobenzene, 50% acetic acid and 10% methyl paratoluene sulfonate on the basis of the weight of the yarn.

After 1 hour at the boil, the bath is practically exhausted. The skein is colored red and this coloration resists washing at 50° C in soapy water and washing in acetone. The sample has a dry dye percentage on the basis of the yarn weight of 1.85%.

B. A skein made of the same yarn dyed in a similar way but without methyl paratoluene sulfonate does not exhaust the bath and the yarn coloration clearly decreases on washing in soapy water at 50° C and in acetone. The sample dye percentage on the basis of the yarn weight is 0.40%.

C. A polymer identical to the polymer prepared in A but without N,N-di(ω-hydroxyhexyl)-hexylamine is prepared. The yarns made from this polymer cannot be dyed at all either with or without the presence of methyl paratoluene sulfonate in the dye bath.

EXAMPLE 2

A. A polymer made from polybutylene terephthalate containing 1.5% by mole of 1,3-dimethoxycarbonyl, 5-methylpiperidino benzene is prepared. The polymer obtained exhibits the following characteristics:

| | |
|---|---|
| VI | 920 |
| Viscosity in the molten state at 260° C | 1,990 poises |
| Softening point | 222.2° C |

This polymer is extruded through a spinneret pierced with 23 holes 0.34 mm in diameter. The filaments obtained are pin-drawn at 85%C and plate-drawn at 120° C at a draw ratio of 4.4 ×.

A bath is prepared from 1 g diammonium phosphate, 0.5 g condensate of stearyl and oleylamines with ethylene oxide, 0.4 g CI Acid Blue 252 and sufficient deionized water to make 1 liter. The bath to yarn ratio (ml/g) is of 100. Dyeing is carried out in the presence of 20% 1,2,4-trichlorobenzene, 50% acetic acid and 10% methyl paratoluene sulfonate on the basis of the weight of the yarn.

After 1 hour at the boil, the bath is practically exhausted. The skein is colored deep blue and the coloration is fast to washing in soapy water at 50° C and in acetone. Dye percentage measured on the yarn is 2.40% based on the weight of the yarn.

B. A skein made from the same polymer and spun under the same conditions is dyed in the same way, but without methyl paratoluene sulfonate. The percentage of dye measured on the yarn is 1.55% based on the weight of the yarn.

EXAMPLES 3 to 24

In the following examples, the polyesteramine used is the polybutylene terephthalate containing 1.6% by mole of N,N-di(ω-hydrohexyl)-benzylamine. After spinning through a spinneret pierced with 23 holes 0.34 mm in diameter, the filaments are pin-drawn at 80° C and plate-drawn at 120° C at a draw ratio of 4.4 ×. The filaments obtained exhibit the following characteristics:

| | |
|---|---|
| Count | 77 dtex |
| Tenacity | 39 g/tex |
| Elongation | 12.4% |

Whenever an alkylating treatment is carried out before dyeing, this is done in 100 ml of reaction medium on 2 g skeins.

In all the hereafter mentioned examples (except where otherwise stated) dyeing is carried out with 4% by weight of CI Acid Red 266 based on the weight of the yarn for 1 hour at 100° C, in the presence of 50% 1,2,4-trichlorobenzene and 50% acetic acid by weight based on the weight of the yarn.

EXAMPLES 3 to 7

The alkylating treatment is carried out in methanol at 65° C. The conditions of the various tests are summarized in the following table:

| Examples | Alkylating agent | % | Duration (min) | Carrier (%) |
|---|---|---|---|---|
| 3 | methyl p-toluene sulfonate | 10 | 15 | 50 |
| 4 | " | 10 | 60 | 50 |
| 5 | " | 0 | 60 | 50 |
| 6 | benzyl chloride | 5 | 60 | 0 |
| 7 | " | 0 | 60 | 0 |

In examples 3, 4 and 6, the coloration of dyed skeins is medium and fast to repeated washings in acetone and soapy water at 60° C, whereas in examples 5 and 7, coloration is very poor.

EXAMPLES 8 to 10

Isopropanol at 82° C as the solvent and benzyl chloride as the alkylating agent are used.

| Examples | Alkylating agent | Duration (min) | Carrier (%) |
|---|---|---|---|
| 8 | 5 | 60 | 0 |
| 9 | 10 | 15 | 0 |
| 10 | 0 | 15 | 0 |

Skeins of examples 8 and 9 are somewhat better dyed than those of examples 3, 4 and 6 and their coloration also resists repeated washings in soapy water and acetone at 60° C. The coloration of the skein of example 10 is poor.

EXAMPLES 11 to 15

The alkylating treatment is carried out in isobutanol at 108° C.

| Examples | Alkylating agent | % | Duration (min) | Carrier (%) |
|---|---|---|---|---|
| 11 | methyl p-toluene sulfonate | 10 | 15 | 50 |
| 12 | " | 10 | 60 | 50 |
| 13 | " | 0 | 60 | 50 |
| 14 | benzyl chloride | 10 | 60 | 50 |
| 15 | " | 0 | 60 | 50 |

Samples of examples 11, 12 and 14 are very bright red color and their coloration remains practically unchanged after repeated washings in soapy water and acetone; the dye baths of examples 11 and 14 being completely exhausted. Samples of examples 13 and 15 are poorly colored.

EXAMPLES 16 to 21

The alkylating treatment is carried out in water at 100° C either before dyeing or during dyeing.

A) Before dyeing

| Examples | Alkylating agent methyl p-toluene sulfonate (%) | Duration (min) | Carrier (%) | Percentage of dyestuff/yarn |
|---|---|---|---|---|
| 16 | 1.5 | 60 | 25 | |
| 17 | 5 | 15 | 50 | |
| 18 | 10 | 60 | 0 | 2.20 |
| 19 | 0 | 60 | 0 | 0.45 |

Although the sample coloration of example 16 is markedly stronger than that of example 19, it is, however, essentially less strong than those of examples 17 and 18.

B) During dyeing
In this case, CI Acid Blue 252 is used as dyestuff and the dyeing time is 1 hour.

| Examples | Alkylating agent methyl p-toluene sulfonate (%) | Carrier (%) | % dyestuff/sample |
|---|---|---|---|
| 20 | 10 | 0 | 3.40 |
| 21 | 0 | 0 | 1.45 |

EXAMPLES 22 to 24

Toluene is used as solvent at 110° C.

| Examples | Alkylating agent | % | Carrier (%) | Duration (min) |
|---|---|---|---|---|
| 22 | methyl p-toluene sulfonate | 10 | 0 | 60 |
| 23 | benzyl chloride | 10 | 0 | 60 |
| 24 | " | 0 | 0 | 60 |

Skeins of examples 22 and 23 are medium colored and their coloration resists repeated washings in soapy water and acetone at 60° C whereas the skein of example 24 is very poorly colored.

EXAMPLE 25

An interpolyester is prepared in the usual manner from dimethyl terephthalate and dimethyl isophthalate in a molar ratio of 80/20, with 1,4-cyclohexanedimethanol, this polyester being modified by 2% by mole of N,N-di(ω-hydroxyhexyl)-hexylamine.

The polymer obtained has the following characteristics:

| | |
|---|---|
| IV | 730 |
| Viscosity in the molten state at 290° C | 1,200 poises |
| Softening pont | 255.4° C |

The polymer, after drying, is melted at 260° C and extruded through a spinneret pierced with 23 holes 0.34 mm in diameter. The filaments obtained after drawing at a draw ratio of 4.1 × on a pin at 80° C and on a plate at 120° C have the following characteristics:

| | |
|---|---|
| Total count | 65 dtex |
| Dry tenacity | 24.3 g/tex |
| Elongation | 15.6% |

A 2.5 g skein made of this yarn is treated for 15 minutes in 100 ml of boiling water containing 10% methyl p-toluene sulfonate and 50% 1,2,4-trichlorobenzene on the basis of the weight of the yarn.

After washing in soapy water and acetone, the skein is dyed for one hour at the boil with 4% CI Acid Red 266 on the basis of the weight of the yarn in the presence of 50% 1,2,4-trichlorobenzene and 50% acetic acid on the basis of the weight of the yarn. The deep red coloration of the yarn remains practically unchanged after washings in soapy water and acetone.

EXAMPLE 26

Preparation of a polymer made from polyhexamethylene glycol terephthalate modified by 2% by mole of N,N-di(ω-hydroxyhexyl)benzylamine exhibits the following characteristics:

| | | |
|---|---|---|
| VI | | 670 |
| Viscosity in the molten state at | 260° C | 200 poises |
| " | 200° C | 550 poises |
| Melting point | | 144° C |

This polyesteramine, molten at 160° C, is extruded through a spinneret pierced with 23 holes 0.34 mm in diameter.

The filaments obtained after pin-drawing at 80° C and plate-drawing at 90° C at a draw ratio of 2.9 ×exhibit the following characteristics:

| | |
|---|---|
| Total count | 120 dtex |
| Dry tenacity | 12.2 g/tex |
| Elongation | 8.8% |

A 2.5 g skein made of this yarn is treated for 15 minutes in 100 ml water at 90° C containing 10% methyl p-toluene sulfonate on the basis of the weight of the yarn.

After washing in hot soapy water and in acetone, the skein is dyed for one hour at 90° C with 4% CI Acid Red 266 in the presence of 50% acetic acid, both amounts on the basis of the weight of the yarn.

The very deep red coloration of the yarn remains nearly unchanged after washings in soapy water and acetone.

EXAMPLE 27

A. A polybutylene terephthalate modified by 1.6% by mole of N,N-di(ω-hydroxyhexyl)hexylamine exhibiting a viscosity index of 1,120 and a viscosity in the molten state at 260° C of 2,440 poises is prepared.

B. A polybutylene terephthalate modified by 2.1% by mole of N,N-di(ω-hydroxyhexyl)hexylamine exhibiting a viscosity index of 1,130 and a viscosity in the molten state at 260° C of 1,970 poises is prepared.

Polymers A and B are dried at 120° C under 1 torr for 15 hours, then molded in the form of specimens 75 mm long, 4 to 6 mm wide and 1 to 4 mm thick on DK 65/40 screw press under the following conditions:

| | Polymer A | Polymer B |
|---|---|---|
| Temperature of the screw forepart | 250° C | 250° C |
| Temperature of the screw middle part | 270° C | 270° C |
| Temperature of the screw rear part | 270° C | 270° C |
| Temperature of the nozzle | 235° C | 235° C |
| Temperature of the mold | 60° C | 60° C |
| Time of injection | 15 seconds | 15 seconds |
| Time of cooling in the mold | 10 seconds | 10 seconds |
| Time of opening and closing (between two cycles) | 2 seconds | 2 seconds |
| Injection pressure | 40 bars | 35 bars |
| Material weight | 63 g | 63 g |

The small plates obtained are dyed in three baths each containing 4% by weight based on the weight of the material to be dyed, in one of the following dyestuffs:

CI Acid Red 266
CI Acid Yellow 135
CI Acid Green 28

They also contain 10% methyl paratoluene sulfonate, 50% trichlorobenzene, 50% acetic acid and are kept at the boil for 1 hour.

After dyeing, the small plates are washed in soapy water, rinsed in hot water and again washed in acetone.

It is found that the small plate coloration is fast to the different washings and rinsings, that the dyestuff penetration is about 0.1 mm in all plates and that in any case the shades obtained are deep. The plates made from polymer A exhibit shades which are not as deep as plates made from polymer B, due to the different amine content in these copolymers.

What is claimed is:

1. A process for dyeing shaped articles made from polyesteramines issuing from:

a. at least an aromatic dicarboxylic diacid and possibly a small amount of an aliphatic diacid;

b. at least a diol selected from the group consisting of an aliphatic diol, saturated alicyclic diol and a cycloaliphatic diol, said diol having at least three carbon atoms in the molecule; and c. at least a compound of the formula $NR_3$ where R, being the same or different, is alkyl, saturated alicyclic, cycloalkyl or arylaliphatic, or where two R groups form a cycle between them;

said $NR_3$ compound having 1, 2 or 3 R groups containing 0, 1, 2 or 3 ester generating groups with the total number of ester generating groups being 1 to 3;

said $NR_3$ compound having no more than two R groups being arylaliphatic or cycloaliphatic which have only one carbon atom between the cycle and the nitrogen atom or being saturated alicyclic;

said $NR_3$ compound having at least 3 or more carbon atoms between each of said ester generating groups and the nitrogen atom; and the total amount of said $NR_3$ compound being present so that the percentage of nitrogen fixed on the polymer is from 0.03% to 1.0% by weight of the polymer;

which comprises treating the article with an alkylating agent present in the form of a solution or emulsion in an amount of at least 1.5% by weight based on the weight of said article and at a temperature higher than room temperature for at least 15 minutes while simultaneously dyeing said article with an anionic dye stuff.

2. A process according to claim 1, wherein the amount of said alkylating agent used is at least 5% by weight based on the weight of said article being treated.

3. A process according to claim 1, wherein the treating medium containing said alkylating agent also contains a polar compound.

4. A process according to claim 3, wherein said polar compound is water.

5. A process according to claim 1, wherein the alkylating treatment is carried out in the presence of a carrier.

6. A process according to claim 1, wherein the dyeing is carried out in the presence of a carrier.

7. Shaped articles made from polyesteramines dyed with anionic dyestuffs according to claim 1.

8. A process according to claim 1 wherein said alkylating agent is selected from the group consisting of esters of strong acids, iodides, bromides, chlorides, sulfates, phosphates, phosphonates, and sulfonates.

9. A process according to claim 8 wherein said alkylating agent is selected from the group consisting of trichloroacetates, allyl chloride, benzyl chloride, and methyl paratoluene sulfonate.

* * * * *